US007438294B2

(12) United States Patent
Mendola et al.

(10) Patent No.: US 7,438,294 B2
(45) Date of Patent: Oct. 21, 2008

(54) METHOD FOR PLAYING A CARD GAME

(76) Inventors: Todd Michael Mendola, 32105 Jefferson, Saint Clair Shores, MI (US) 48082; Michael Edward Chevalier, 22930 Arcadia St., Saint Clair Shores, MI (US) 48082

( * ) Notice: Subject to any disclaimer, the term of this patent is extended or adjusted under 35 U.S.C. 154(b) by 340 days.

(21) Appl. No.: 11/263,158

(22) Filed: Oct. 31, 2005

(65) Prior Publication Data

US 2007/0096394 A1 May 3, 2007

(51) Int. Cl.
*A63F 1/00* (2006.01)
*A63F 9/20* (2006.01)

(52) U.S. Cl. ..... 273/292; 273/303

(58) Field of Classification Search ..... 273/292, 273/303

See application file for complete search history.

(56) References Cited

U.S. PATENT DOCUMENTS 5,678,821 A 10/1997 Hedman
6,012,719 A 1/2000 Webb
6,179,293 B1 1/2001 Hedman
6,371,867 B1 4/2002 Webb
6,481,717 B1 11/2002 Richardelle
6,481,719 B2 11/2002 Webb
6,523,831 B2 2/2003 Webb
6,749,200 B2 6/2004 Yurkins
6,863,274 B2 3/2005 Webb
6,874,786 B2 4/2005 Bruno et al.
6,877,748 B1 4/2005 Patroni et al.
2001/0035610 A1 11/2001 Webb
2002/0000693 A1 1/2002 Webb
2004/0000758 A1 1/2004 Yurkins
2004/0164491 A1* 8/2004 Webb ..... 273/274
2005/0116414 A1 6/2005 Yurkins

OTHER PUBLICATIONS

John Scarne, "Scarne's Encyclopedia of Games", 1973, Harper and Row, First Edition, p. 26.*

* cited by examiner

*Primary Examiner*—Gene Kim
*Assistant Examiner*—Michael D Dennis
(74) *Attorney, Agent, or Firm*—Law Offices of John Chupa & and Associates, P.C.

(57) ABSTRACT

A methodology 10 for playing a card game which combines the games of blackjack and poker, which includes a first poker round, and a second blackjack round, and in which a player selectively places a series of wagers selectively forms a five-card poker hand, and selectively forms a blackjack hand in blackjack round.

2 Claims, 2 Drawing Sheets

METHOD FOR PLAYING A CARD GAME

FIELD OF THE INVENTION

The present invention relates to a method for playing a card game, and more particularly, to a card game which may be played in a casino and/or other type of gaming or other environment, which combines the games of blackjack and poker (e.g., desirable "features" of these games), in which a player selectively and cooperatively forms a five-card poker hand, and which allows individual players of the card game to selectively play only a portion of the card game.

BACKGROUND OF THE INVENTION

The game of blackjack is popularly played in many, if not all, the countries of the world, and typically requires each "hand" (e.g., the cards which are respectively held by each player to be compared and evaluated against those of the dealer). The general object of the game is to obtain a high valued hand having a value of twenty-one or less. Should the hand have a computed value which is greater than twenty-one, the player typically and automatically loses. A player "wins the hand" if the value of the player's hand is less than twenty-one but greater than the value of the dealer's hand. Typically, the player "loses the hand" if the value of his hand is equal to the value of the dealer's hand. Sometimes, a "push" is declared and neither the player nor the dealer has a greater computed hand value. To compute the value of a hand, the value of each card in the hand is added until a final amount is determined. For purposes of such counting, the actual or "assigned" value of each card is utilized. If a card is a two, three, four, five, six, seven, eight, nine, or ten, then the actual value of the card is utilized. A value of ten is assigned to each jack, queen, and king. Further, an ace is designated as having a value of one or eleven, depending upon the desire of the holder of the card. For a complete overview of the game of blackjack (and various variations of the game), the reader is directed to the books *Basic Blackjack* by Stanford Wong and *Blackjack Wisdom* by Arnold Synder. These books may be ordered from the website entitled www.conjelco.com and are each fully and completely incorporated herein by reference, word for word and paragraph for paragraph. Another overview may be obtained in the texts entitled *The Winner's Guide To Texas Hold'em Poker*. by Ken Warren (1st ED.), Cardoza Publishing (1996), ISBN Number 0940685590 and *Blackjack, a winner's handbook* by Jerry L. Patterson, Perigee Books (1990), ISBN Number 0399515984 which are each fully and completely incorporated herein by reference, word for word and paragraph for paragraph.

While the game of blackjack is well known, it is regarded by many as being boring, especially if played for a relatively long period of time. Further, with the relatively large increase in gaming establishments, each playing substantially the same games, it has been difficult for these gaming establishments to differentiate themselves and increase their market share based upon their suite of offered games. One well regarded way of a gaming establishment to differentiate itself it for it to offer a new and novel game which becomes very popular in a very quick or fast manner.

Additionally, there exist known games and/or methods for playing games which typically combine some of the elements of the game of blackjack (both "conventional" versions and variants) with elements of another known card game and/or other game. While these "combination" games typically do somewhat entertain players, they are often considered to be boring. There is therefore a need for a new and novel card game which is entertaining to players, which produces income for a gaming and/or other establishment, and which allows players a wide variety of styles and wagers which can be made while playing.

The present invention overcomes these previously delineated drawbacks in a new and novel fashion. It provides a method for playing a card game which combines elements of the games of poker and blackjack, which allows players to use a two-card blackjack hand to form a five-card poker hand, and which offers players a wide variety of styles and wagers which can be made and/or chosen during the game. Additionally, the present invention offers an advantage to a "house" or gaming establishment which offers the present invention for play, thereby increasing revenue while satisfying the players, all in a new and novel manner.

SUMMARY OF THE INVENTION

It is a first non-limiting object of the present invention to provide a method for playing card game and a card game which overcomes some or all of the previously delineated drawbacks associated with current and/or prior card games.

It is a second non-limiting object of the present invention to provide a method for playing card game which overcomes some or all of the previously delineated drawbacks associated with current and/or prior card games and which combines some or all of the elements of the games of blackjack and poker.

It is a third non-limiting object of the present invention to provide a method for playing card game which overcomes some or all of the previously delineated drawbacks associated with current and/or prior card games which combines some or all of the elements of the games of blackjack and poker, and which allows a player to selectively play only a certain portion of the card game.

It is a fourth non-limiting object of the present invention to provide a method for playing card game which overcomes some or all of the previously delineated drawbacks associated with current and/or prior card games which combines some or all of the elements of the games of blackjack and poker, which allows a player to selectively play only a certain portion of the card game and which increases the revenue of a gaming establishment.

It is a fifth non-limiting object of the present invention to provide a method for playing card game which overcomes some or all of the previously delineated drawbacks associated with current and/or prior card games which combines some or all of the elements of the games of blackjack and poker, which allows a player to selectively play only a certain portion of the card game, which increases the revenue of a gaming establishment, and which allows players to have increased control over the amount and placement of wagers.

According to a first non-limiting aspect of the present invention, a method for playing a card game is provided which comprises elements of blackjack and poker, and wherein said card game comprises at least two rounds of play, and wherein said first round of play comprises cooperatively forming a five-card poker hand from a two-card hand, a dealer's "faced up" card, and 2 shared cards.

According to a second non-limiting aspect of the present invention, a method for playing a card game is provided which comprises the steps of dealing a two-card hand to at least one player, at least one card to a dealer, and at least 2 shared cards; wherein said at least one player and said dealer each respectively form a five-card hand including cards from said two-card hand dealt to said at least one player, said at least one card dealt to a dealer, and said shared cards; comparing said each respective said five-card hand to each other respective said five-card hand; designating a winner; and continuing with a blackjack game with said two-card hand.

These and other aspects, objects, and advantages of the present invention will become apparent to one of ordinary skill in the art by reading the following detailed description of the preferred embodiment of the invention and by reference to the following drawings.

DETAILED DESCRIPTION OF THE PREFERRED EMBODIMENT OF THE INVENTION

Figure 1:
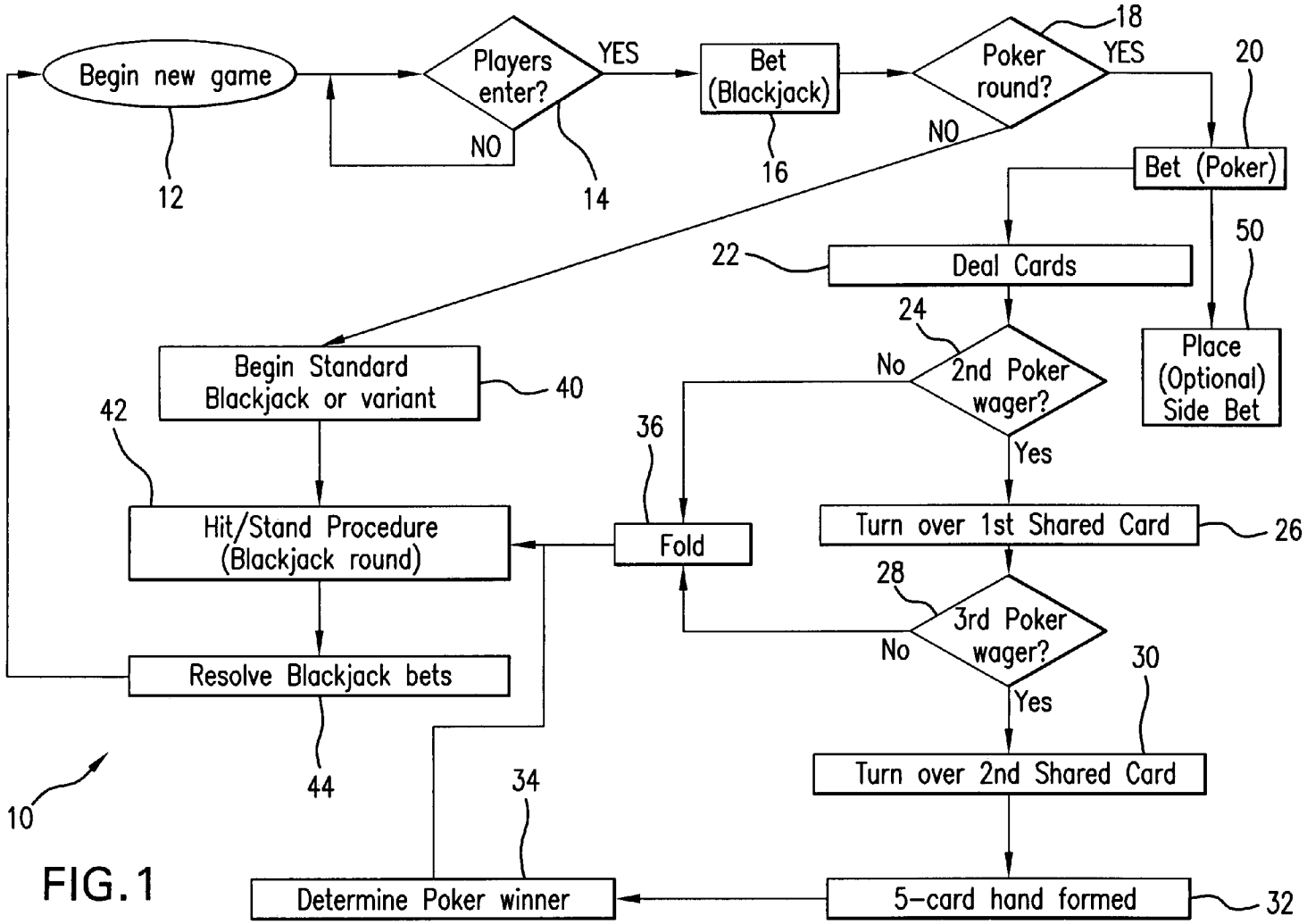
FIG. 1 comprises a sequence of steps which cooperatively comprises a methodology for playing a card game according to the teachings of the preferred embodiment of the invention.
Figure 2:
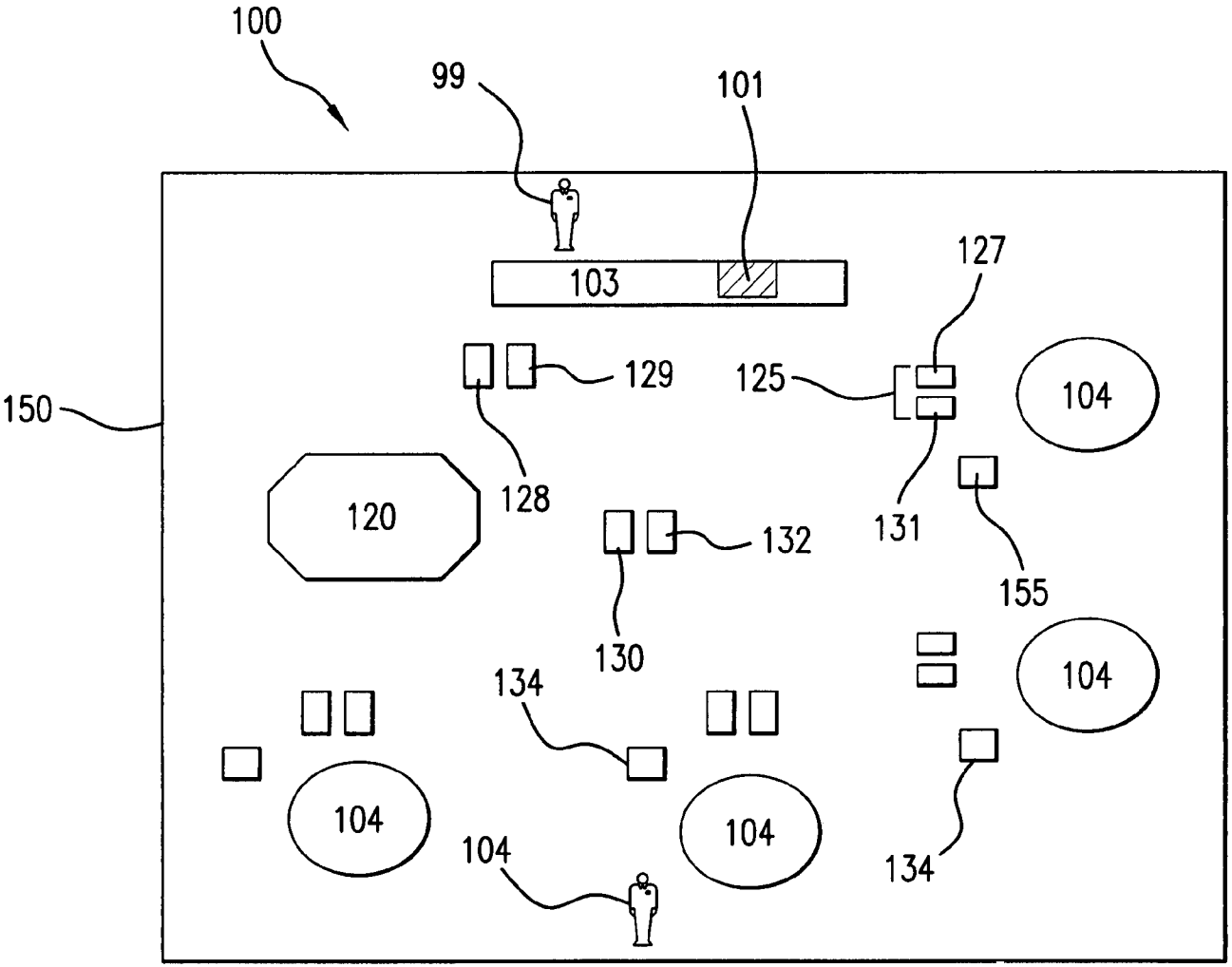
FIG. 2 is a top view of a gaming table layout of a card game played according to the methodology shown in FIG. 1.

Referring now to FIGS. 1-2, there is shown a methodology 10 for playing a card game by use of table or playing surface, such as playing table or surface 100, which combines the games of blackjack and poker. Particularly, there is shown a game layout 100 (e.g., a table top assembly) in which a five-card poker hand is formed, by a player, a poker game is played and then a blackjack game played by the player. Thus, each player may selectively play a poker game and a blackjack game, thereby making the game interesting and fun.

Referring now to FIG. 1, there is shown a gaming methodology 10 which demonstrates or "comprises" the flow and/or "structure" of the card game 10 in the most preferred embodiment of the invention. It should be appreciated that the card game methodology and/or decision process 10 may be directed by a human dealer, a "computerized" dealer, and/or computer program, or by substantially any other desired means, and each unique player of the game has opportunity to selectively place or withhold wagers during the game. It should further be appreciated that the card game may be played in substantially any environment, by substantially any desired number of players, including by way of example and without limitation, in a casino, other gaming establishment, or at an individual's home. Finally, it should be apparent that the game methodology and/or decision process 10 may, in one non-limiting embodiment of the invention, incorporate some and/or all of the rules and strategies conventionally and/or typically used in poker and blackjack (both traditionally and in known and unknown variants), and that any reference to continuing the game in the conventional manner should be taken to mean that the game methodology 10 reverts, at that point, to the "house" rules or any other desired rules for the variant of poker or blackjack in question. For example and without limitation, in one non-limiting embodiment of the invention, a "poker winner" is selected by determining which five-card poker hand has the highest value according to "conventional" poker rules (e.g., such as those governing the game of "Texas Hold Em"). In another non-limiting embodiment of the invention, once the "poker winner" has been determined, the rest of the game proceeds under traditional and/or any other desired rules for the game of "conventional" blackjack.

The methodology 10 for the new and novel game begins when the dealer or game operator announces the beginning or the "start" of a new game and/or "round", in step 12. At least one player selectively "enters" the game 10 in step 14 (i.e., decides to play) the game, and that player places a blackjack bet, or "wager" in step 16. The player may then selectively and additionally "enter" a poker round in step 18. In one non-limiting embodiment of the invention, if the poker round is not entered by at least two players in step 18, then the game reverts to only that of a traditional blackjack game in step 40 (i.e., a two-card hand is dealt to each player and the dealer and then a "conventional" game of blackjack is played). It should be understood that if at least two players selectively enter the poker round in step 18, any other "non-poker" players must "wait" or are "held" until any poker round is completed, at which time a game of blackjack may begin. It should be further realized that the "held" player or players do not participate in the steps of the poker round which are described hereafter, and therefore do not selectively form a five-card poker hand in the manner described in more detail below. In one non-limiting embodiment of the invention, a "held" player is dealt a two-card hand, but does not use them for during the poker round.

Any player who selectively enters the poker round in step 18 then places a bet or "wager" in step 20. It should be realized that the blackjack and poker bets are kept separated or segregated by the dealer and/or other individual or mechanism directing the gaming methodology 10. In one non-limiting embodiment of the invention, players may selectively place a side bet 50 (e.g., into a bad beat type pot such as is known in the art). For example and without limitation, the dealer may declare that any player may "play" or "wager" side bet 50, and that if a player places a certain amount of money into a "side bet pot", and if the subsequent poker round 18 results in one or more players holding a five-card poker hand which has a certain value (for example and without limitation, "four of a kind" beats a "full house with aces over tens"), then any player who has participated in the side bet will receive an award (e.g., double the amount wagered, or a portion of the "side bet pot"), and in one non-limiting embodiment, the award is distributed at the end of the round. Once the bets, in steps 16, 20 are placed, the dealer commences dealing the cards for game 12, in step 22. In one non-limiting embodiment of the invention, a player may selectively place such a "side bet" without actually playing poker.

In one non-limiting embodiment of the invention, as best shown in FIG. 2, the blackjack bet of a player 103 is held near the player at a position 104 which is closest to that player 103 and the poker bet is placed into a "poker ante" 134 near that player 103. In this non-limiting embodiment of the invention, cards are dealt from a shoe and/or other card holding device and/or "deck" 101 (which is placed onto position 103) by a dealer 99 in the following sequence for each player who is "playing" blackjack: a first pair of cards 130, 132 are placed on to the playing surface 150 (e.g., a card or "gaming" table) in a face-down manner (i.e., the cards are placed so that their value or respective front surfaces cannot be seen); and the dealer 99 then deals a "standard" blackjack hand to each player 104 and to the dealer 99 (i.e., the dealer 99 receives two cards 128, 129, this first one faced up and the other faced down which are placed upon the playing surface 150 close to the dealer 99; and each player 103 respectively receives a two-card hand 125, having two cards 127, 131 which are placed in a "faced up" position). It should be understood that this description of the configuration in which the cards are dealt is not meant to limit the invention, and that substantially any desired configuration may be specified at the time of play.

In one non-limiting embodiment of the invention, each of the cards 130, 132 is considered a "shared" card (i.e., each player 99 may consider the cards 130, 132 as "theirs" and utilize these shared cards 130, 132 as part of their respective poker hands). The dealer 99 performs a sequence of dealing by dealing a first card 127 face-up, to each player 102 then a first card 128 face-down to the dealer 102, a second card 131 face-up to each player 104, and a second card 129 face-up to the dealer 102.

Once the cards are dealt in step 22, in the previously described manner, each player 104 who has a poker wager participates in a poker game by selectively staying or raising their original poker wager (i.e., the player places an amount which is equal to or higher than the original poker wager 20 into the "poker pot" 120), in step 24, thereby selectively remaining "in" the poker round 18. Alternatively, and in this embodiment any and/or all players may choose to "fold" their hand and enter step 36 from step 24 (i.e., to "quit" or otherwise cease to play the poker play).

Step 24 is meant to and does represent a first "round of betting" according to any desired type of poker game. In one non-limiting embodiment of the invention, if any player decides to "fold", in step 36, any monies and/or other items which were submitted to enter the poker round are forfeited (i.e., the money remains in the "poker pot" 120 and is awarded to the poker winner). Once any player or players have selectively completed a first round of poker betting, in step 24, the first "shared" card 130 is turned over to reveal its face or value, in step 26. The players then engaged in a second round of poker betting in step 28 in the same manner as the first round of betting in step 24. In one non-limiting embodiment of the invention, after the wagers, in step 28, are made, the second "shared" card 132 is turned over and/or "faced up". It should be realized that any player 104 who selectively folds their hand instead of wagering in step 24, 28 automatically advances in the methodology 10 to the blackjack round in step 42.

Once both cards 130, 132 have been turned over in the foregoing fashion, the poker hand is "called" or evaluated in step 32 (e.g., the poker round 18 is declared complete and the results are "resolved" or determined in the usual manner).

In one non-limiting embodiment of the invention, resolution of the hand, in step 34, is reached when each player forms a five-card poker hand using a two-card blackjack hand 125, (e.g., cards 127, 131), the "faced up" dealer card 129, and the "shared" cards 130, 132. In this non-limiting embodiment, the five-card hand with the highest traditional poker value is declared the winner (e.g., "four-of-a-kind" would be declared better than a "full house"), and that player or players 104 receives the "poker pot" 120 (i.e., the content of which include the original poker wagers in step 20, and the amounts of the first and second selectively made poker wagers, in steps 24, 28. In one non-limiting embodiment of the invention, the "house" (i.e., the gaming and/or gambling establishment) receives ten percent (10%) or some other predetermined percentage of the "poker pot 120" before it is distributed to the poker winner(s). In another non-limiting embodiment of the invention, each remaining player (e.g., the players who do not fold) forms a five-card hand in step 32 as described in the methodology 10 and any five-card hand which is equal to or "better than"(i.e., which is traditionally valued more highly under poker rules) a predetermined value receives a prize, which may be (but is not limited to) a standard prize, a fraction of the "poker pot" 120 or a prize based upon the poker value of the hand.

After the poker winner has been determined, in step 34, the methodology 10 proceeds to the completion of a conventional blackjack round in step 42. To complete the game 10, the dealer 102 carries out a conventional or known blackjack "hit/stand" procedure, wherein each player uses the two-card hand 125 to begin the blackjack round, and any player who is declared a "winner" (i.e., any player 104 whose blackjack hand "beats" the dealer's hand in a conventional manner) receives their resolved blackjack bet 44 and the dealer may then announce a new game 12.

It should be apparent that the methodology 10 provides each player 104 with an exciting and simple variant and/or combination of the games of blackjack and poker. In the most preferred embodiment of the invention, both the blackjack and the poker rounds are played under traditional rules. It should be realized that substantially any desired variant of the games of poker and/or blackjack may be used in place of the traditional variant if it is so desired (e.g., by the dealer and/or gaming establishment).

It should be realized that the previously described methodology 10 is only the preferred embodiment of the invention, and that substantially any other desired rules, strategies, and/or methods of play may be substituted if an individual so desires. It should further be realized that in no way is this description meant to limit the process or the methodology by which the card game is played. For example and without limitation, the methodology 10 may be adapted to run as a computer program (i.e., the computer takes the role of "dealer," and the interface would be computerized (i.e., an LCD or "touch-screen"). There are therefore a wide variety of game methodologies and processes which are conceivable without departing from the scope and the spirit of the invention.

It should be apparent, from the previous discussion, that in the most preferred methodology 10 of the card game 100, in each new game 12 at least one player 104 selectively places a blackjack bet, is selectively dealt a two-card blackjack hand 125 and may the selectively place a series of poker wagers. In this non-limiting embodiment of the methodology 10, each "poker" player cooperatively forms a five-card poker hand using "their" two-card blackjack hand 125, the "faced-up" dealer card 129, and the two "shared" cards 130, 132. Once a poker winner has been declared 34, the game 100 continues with a blackjack round 42. In one non-limiting embodiment, this blackjack round 42 is cooperatively played under "traditional" blackjack rules, using the respective two-card blackjack hands 125 and the dealer cards 128, 129. It should be apparent that the game 100 then uses the standard "hit/stand" procedure (i.e., under the rules of traditional and/or a variant of blackjack) until the blackjack round ends. Each individual blackjack bet 155 is then resolved and the dealer may selectively announce the beginning of a new game 12. Non participating poker players may place money in the side pot in step 80, and "bet" on the winner of the poker game (e.g., received a predetermined multiple of the bet dependent upon their success/failure selecting the poker winner).

It is to be understood that the invention is not limited to the exact construction and methodology described above, but that various changes and no defecators may be made without departing from the spirit and the scope of the inventions as delineated in the following claims.

What is claimed is:

1. A method for playing a card game comprising the steps of providing a dealer; accepting a blackjack wager from a first player; accepting a blackjack wager from a second player; accepting a blackjack wager from a third player; accepting a request by said first player to play poker; accepting a request by said second player to play poker; accepting a poker bet from said first player; accepting a poker bet from said second player; allowing only said first and said second player to play poker; accepting a side bet from said third player; giving said first player a first pair of cards, wherein each of said first pair of cards has a respective face portion which is concealed from said second and third players; giving said second player a second pair of cards, wherein each of said second pair of cards has a respective face portion which is concealed from said first and third players; giving said third player a third pair of cards; placing a fourth pair of cards upon a surface, wherein each of said fourth pair of cards includes a respective face portion and wherein said face portion of said first of said fourth pair of cards is concealed from said first, second, and third players and wherein said face portion of the second of said fourth pair of cards is concealed from said first, second, and third player; giving a fifth pair of cards to said dealer, wherein a first of said fifth pair of cards has a face portion which is concealed from said first, second, and third players and wherein a second of said fifth pair of cards has a face portion which is exposed to said first, second, and third players; allowing said first and said second players to determine whether they will both keep their respective and original poker bets constant and, if not, allowing each of said first and second players to fold and discontinue with playing poker; determining whether one of said first and second players has folded and, if so, declaring the other player a poker winner and providing money to said other player, and if neither said first and second player have folded then exposing said face portion of the first of said fourth pair of cards to said first and second players; after exposing said face portion of the first of said fourth pair of cards to said first and second player, again allowing said first and second players to determine whether they will both keep their previously made poker bets constant and, if not, allowing each of said first and second players to fold and discontinue with playing poker; again determining whether one of said first and second players has folded and, if so, declaring the other player a poker winner and providing money to said other player, and if neither said first and second player have folded then exposing said face portion of the second of said fourth pair of cards to said first and second players; forming a first poker hand by use of said exposed fourth pair of cards, said first pair of cards, and said second of said fifth pair of cards; associating said first poker hand with said first player; forming a second poker hand by use of said exposed fourth pair of cards, said second pair of cards, and said second of said fifth pair of cards; associating said second poker hand with said second player; comparing said first and second poker hands and using said comparison to select, as a poker winner, one of said first and second players; paying money to said selected poker winner; separately evaluating each of said first and second poker hands; paying money to said third player based upon said evaluation of said first and second poker hands; taking said side bet if no money is paid to said third player; allowing said dealer and each of said first, second, and third players to play a game of blackjack only after declaring a poker winner and only after determining whether to pay money to said third player, wherein said amount of money paid to said poker winner comprises a percentage of all of the money received as a poker bet from said first and second players and wherein money is paid to said third player only if at least one of said evaluated first and second poker hands exceeds a certain poker value.

2. A method for playing a card game comprising the steps of providing a dealer; accepting a blackjack wager from a first player; accepting a blackjack wager from a second player; accepting a blackjack wager from a third player; accepting a request by said first player to play poker; accepting a request by said second player to play poker; accepting a poker bet from said first player; accepting a poker bet from said second player; allowing only said first and said second player to play poker; accepting a side bet from said third player; giving said first player a first pair of cards, wherein each of said first pair of cards has a respective face portion which is concealed from said second and third players; giving said second player a second pair of cards, wherein each of said second pair of cards has a respective face portion which is concealed from said first and third players; giving said third player a third pair of cards; placing a fourth pair of cards upon a surface, wherein each of said fourth pair of cards includes a respective face portion and wherein said face portion of said first of said fourth pair of cards is concealed from said first, second, and third players and wherein said face portion of the second of said fourth pair of cards is concealed from said first, second, and third player; giving a fifth pair of cards to said dealer, wherein a first of said fifth pair of cards has a face portion which is concealed from said first, second, and third players and wherein a second of said fifth pair of cards has a face portion which is exposed to said first, second, and third players; allowing said first and said second players to determine whether they will both keep their respective and original poker bets constant and, if not, allowing each of said first and second players to fold and discontinue with playing poker; determining whether one of said first and second players has folded and, if so, declaring the other player a poker winner and providing money to said other player, and if neither said first and second player have folded then exposing said face portion of the first of said fourth pair of cards to said first and second players; after exposing said face portion of the first of said fourth pair of cards to said first and second player, again allowing said first and second players to determine whether they will both keep their previously made poker bets constant and, if not, allowing each of said first and second players to fold and discontinue with playing poker; again determining whether one of said first and second players has folded and, if so, declaring the other player a poker winner and providing money to said other player, and if neither said first and second player have folded then exposing said face portion of the second of said fourth pair of cards to said first and second players;

forming a first poker hand by use of said exposed fourth pair of cards, said first pair of cards, and said second of said fifth pair of cards; associating said first poker hand with said first player; forming a second poker hand by use of said exposed fourth pair of cards, said second pair of cards, and said second of said fifth pair of cards; associating said second poker hand with said second player, comparing said first and second poker hands and using said comparison to select as a poker winner, one of said first and second players; paying money to said selected poker winner; separately evaluating each of said first and second poker hands; paying money to said third player based upon said evaluation of said first and second poker hands; taking said side bet if no money is paid to said third player; allowing said dealer and each of said first, second, and third players to play a game of blackjack only after declaring a poker winner and only after determining whether to pay money to said third player, wherein said amount of money paid to said poker winner comprises a percentage of all of the money received as a poker bet from said first and second players and wherein money is paid to said third player only if said third player had correctly predicted the identity of said declared poker winner.

* * * * *